US011178949B2

(12) United States Patent
Katz et al.

(10) Patent No.: US 11,178,949 B2
(45) Date of Patent: Nov. 23, 2021

(54) TRAVEL ACCESSORY AND METHOD

(71) Applicants: Menachem Katz, Chicago, IL (US); Anna Juhasz, Chicago, IL (US)

(72) Inventors: Menachem Katz, Chicago, IL (US); Anna Juhasz, Chicago, IL (US)

( * ) Notice: Subject to any disclaimer, the term of this patent is extended or adjusted under 35 U.S.C. 154(b) by 247 days.

(21) Appl. No.: 16/240,078

(22) Filed: Jan. 4, 2019

(65) Prior Publication Data

US 2019/0216197 A1 Jul. 18, 2019

Related U.S. Application Data

(60) Provisional application No. 62/617,769, filed on Jan. 16, 2018.

(51) Int. Cl.

| | |
|---|---|
| ***A45C 13/30*** | (2006.01) |
| ***A45C 5/06*** | (2006.01) |
| ***A45C 13/28*** | (2006.01) |
| ***A45C 13/10*** | (2006.01) |
| *A45C 13/00* | (2006.01) |
| *A45C 7/00* | (2006.01) |

(52) U.S. Cl.

CPC ..... *A45C 13/1092* (2013.01); *A45C 5/06* (2013.01); *A45C 13/28* (2013.01); *A45C 13/30* (2013.01); *A45C 7/0036* (2013.01); *A45C 13/002* (2013.01); *A45C 2013/306* (2013.01)

(58) Field of Classification Search

CPC ..... A45C 13/28; A45C 13/262; A45C 13/22; A45C 13/001; A45C 2013/303; A45C 2013/306; A45C 13/30; Y10T 24/318

USPC ..... 190/108, 102

See application file for complete search history.

(56) References Cited

U.S. PATENT DOCUMENTS

| | | | | |
|---|---|---|---|---|
| 2,319,729 | A * | 5/1943 | Ford | A45C 13/40 190/102 |
| 4,756,394 | A | 7/1988 | Cohen | |
| 5,209,328 | A | 5/1993 | Kotkins, Jr. | |
| 5,215,379 | A | 6/1993 | Picard et al. | |
| 5,330,141 | A | 7/1994 | Kim | |
| 5,341,928 | A | 8/1994 | Jones et al. | |
| 5,593,009 | A | 1/1997 | King | |
| 5,873,504 | A | 2/1999 | Farmer | |
| 6,098,769 | A | 8/2000 | Yen | |

(Continued)

OTHER PUBLICATIONS

Travel Smith. Bag Bungee Secures Extra Bag, Saves Your Back. Pub. Date: est Jan. 1, 2015. URL: https://www.travelsmith.com/product/bag-bungee.do. Accessed: Dec. 4, 2017.

(Continued)

*Primary Examiner* — John K Fristoe, Jr.
*Assistant Examiner* — Justin Caudill
(74) *Attorney, Agent, or Firm* — Nyman IP LLC; Scott Nyman

(57) ABSTRACT

A travel accessory is provided for carrying and protecting multiple objects including luggage, documents, and other personal items. The travel accessory may include a mounting aspect with mounting panels, attachment aspect with straps, and storage aspect. Electromagnetic shielding may reduce communication of radio frequency transmissions. A method for carrying and protecting multiple objects, luggage, documents, and personal items using the travel accessory is also provided.

15 Claims, 9 Drawing Sheets

(56) References Cited

U.S. PATENT DOCUMENTS

| | | | | |
|---|---|---|---|---|
| 6,213,267 | B1 | 4/2001 | Miller | |
| 6,772,485 | B2 * | 8/2004 | Alpert | A45C 13/30 190/102 |
| 6,966,470 | B1 | 11/2005 | Charlton | |
| 7,503,569 | B2 | 3/2009 | Duvigneau | |
| 8,205,744 | B1 | 6/2012 | Tashjian | |
| D663,119 | S | 7/2012 | Wright | |
| 9,119,453 | B1 | 9/2015 | LaRocque | |
| 2008/0116028 | A1 * | 5/2008 | Gold | A45C 13/30 190/18 A |
| 2010/0019011 | A1 * | 1/2010 | Sugano | A45F 3/04 224/584 |
| 2010/0059322 | A1 | 3/2010 | Reali | |
| 2013/0221047 | A1 | 8/2013 | Johnson | |
| 2014/0110202 | A1 * | 4/2014 | Vesterby | A45C 13/30 190/103 |
| 2014/0366250 | A1 * | 12/2014 | Barone | H05K 9/0043 2/251 |
| 2015/0121730 | A1 | 5/2015 | Freer | |
| 2016/0063829 | A1 | 3/2016 | Kim | |
| 2016/0227949 | A1 | 8/2016 | Klugh et al. | |
| 2016/0372948 | A1 | 12/2016 | Kvols | |

OTHER PUBLICATIONS

EllaKid (Amazon). Stroller Organizer with Removable Shoulder Strap, Universal Fit, Premium Quality Diaper Bag & Stroller Cup . . . . Pub. Date: est Jan. 1, 2016. URL: https://www.amazon.com/Stroller-Organizer-Removable-Shoulder-Universal/dp/B017JEO6X6. Accessed: Dec. 4, 2017.

* cited by examiner

TRAVEL ACCESSORY AND METHOD

CROSS-REFERENCE TO RELATED APPLICATION

This application claims the priority from U.S. provisional patent application Ser. No. 62/617,769 filed Jan. 16, 2018. The foregoing application is incorporated in its entirety herein by reference.

FIELD OF THE INVENTION

The present disclosure relates to a travel accessory. More particularly, the disclosure relates to carrying and protecting multiple objects including luggage, documents, and items.

BACKGROUND

Traveling can be a hassle. This fact is especially true when traveling with multiple pieces of luggage. With airlines increasingly adding fees for checked bags, travelers are more likely to carry-on their luggage during a flight. Even for travelers checking bags, their luggage still needs to be transported on public transit, in a cab, or elsewise between an origin and the transportation center. Managing multiple pieces of luggage can be frustratingly difficult, physically stressful, and generally undesirable.

Some travelers attempt to stack pieces of luggage on top of each other, such as by placing a duffel bag on top of a roller-style suitcase. However, the duffel bag is often prone to falling off the suitcase on which it rests, resulting in damaged or lost bags. To overcome this problem, some travelers attempt to attach the top bags to the bottom piece of luggage with a bungee device. However, the elastic properties of the bungee can smash the contents of the bag, present difficulty in stretching to install, and increase the time and effort necessary to uninstall the bungee when the user needs to separate the bags, for example, at TSA security checkpoints. Bungees are also prone to slipping over the top handle of a rolling suitcase if the carried bag is of any significant size, potentially also causing injury to people from the flinging motion of the failed bungee device. Furthermore, many users find the bungees to be an inadequate solution due to an inability to hold luggage above a threshold weight, breaking, chemical odors emanating from the bungee material, and failure.

Therefore, a need exists to solve the deficiencies present in the prior art. What is needed is an accessory to facilitate traveling with multiple pieces of luggage. What is needed is an accessory removably attachable to at least first and second luggage articles. What is needed is an accessory that is removably installable to luggage. What is needed is an accessory with pockets and locations to store documents. What is needed is an accessory with pockets at least partially including electromagnetic radio frequency shielding. What is needed is an accessory to facilitate traveling that is collapsible into a small form factor for storage when not in use. What is needed is a method of removably securing luggage together. What is needed is a method of removably securing documents with luggage.

SUMMARY

An aspect of the disclosure advantageously provides an accessory to facilitate traveling with multiple pieces of luggage. An aspect of the disclosure advantageously provides an accessory removably attachable to at least first and second luggage articles. An aspect of the disclosure advantageously provides an accessory that is removably installable to luggage. An aspect of the disclosure advantageously provides an accessory with pockets and locations to store documents. An aspect of the disclosure advantageously provides an accessory with pockets at least partially including electromagnetic radio frequency shielding. An aspect of the disclosure advantageously provides an accessory to facilitate traveling that is collapsible into a small form factor for storage when not in use. An aspect of the disclosure advantageously provides a method of removably securing luggage together. An aspect of the disclosure advantageously provides a method of removably securing documents with luggage.

An example of a travel accessory covered by this disclosure may include a mounting aspect for attaching to a primary piece of luggage and an attachment aspect for securing a secondary piece of luggage to the mounting aspect. The travel accessory may also include a storage aspect to receive items and hold the items by the mounting aspect. Additionally, the mounting aspect, the attachment aspect, and the storage aspect may be at least partially constructed using fabric. Furthermore, the attachment aspect may include straps extending outwardly from the mounting aspect to wrap around the secondary piece of luggage. In this example, the mounting aspect may be removable from and attachable to the primary piece of luggage without having to detach from the secondary piece of luggage.

Accordingly, the disclosure may feature a travel accessory including a mounting aspect and an attachment aspect. The mounting aspect may attach to a primary object. The attachment aspect may assist with securing a secondary object to the mounting aspect. The attachment aspect may include a strap extending outwardly from the mounting aspect to substantially secure the secondary object. The mounting aspect may be removable from and attachable to the primary object independently from attachment to the secondary object.

In another aspect, the mounting aspect may include a primary mounting panel with a first peripheral mounting panel attached to the primary mounting panel via a first mounting margin. The first peripheral mounting panel may be pivotable about the primary mounting panel via the first mounting margin.

In another aspect, the mounting aspect may further include a second peripheral mounting panel attached to the primary mounting panel via a second mounting margin. The second peripheral mounting panel may be pivotable about the primary mounting panel via the second mounting margin.

In another aspect, the primary object may be a primary container comprising a primary container handle. The secondary object may be a secondary container that is smaller than the primary container.

In another aspect, the primary object may be a primary luggage comprising a primary luggage handle. The mounting aspect may be installable to the primary luggage handle.

In another aspect, the strap of the attachment aspect may include a primary strap attached to a first mounting strap edge of the primary mounting panel and a receiving strap attached to a second mounting strap edge of the primary mounting panel. The primary strap may be removably receivable by the receiving strap to substantially secure the secondary object to the mounting aspect.

In another aspect, the primary strap may include a first upper primary strap attached to the first mounting strap edge of the primary mounting panel and a second upper primary strap attached to the first mounting strap edge of the primary mounting panel. The primary strap may additionally include a lower primary strap operatively attached to the first upper primary strap and the second upper primary strap and connectable to the receiving strap.

In another aspect, the primary strap may additionally include a support panel attached to the first upper primary strap and the second upper primary strap at a first support panel edge and a link strap attached between a second support panel edge of the support panel and the lower primary strap.

In another aspect, a storage aspect may be included to receive and removably store a personal item.

In another aspect, the storage aspect may include a back-storage surface provided by the mounting aspect, a storage panel, an interior storage space located between the back-storage surface and the storage panel, and a storage flap manipulable to provide access to the interior storage space or substantially conceal the interior storage space.

In another aspect, the storage flap may be operatively attached to the storage panel. The storage flap may additionally include a storage flap magnet to removably hold the storage flap adjacent to the back-storage surface.

In another aspect, at least part of the storage aspect may include electromagnetic shielding to substantially reduce radio frequency communication by the personal item stored by the storage aspect.

In another aspect, the electromagnetic shielding may include a Faraday shield.

According to an embodiment of this disclosure, a travel accessory is provided including a mounting aspect, an attachment aspect, and a storage aspect. The mounting aspect may attach to a primary object. The mounting aspect may include a primary mounting panel and a first peripheral mounting panel attached to the primary mounting panel via a first mounting margin. The first peripheral mounting panel may be pivotable about the primary mounting panel via the first mounting margin. The attachment aspect may secure a secondary object to the mounting aspect. The attachment aspect may include a primary strap attached to a first mounting strap edge of the primary mounting panel and a receiving strap attached to a second mounting strap edge of the primary mounting panel. The primary strap may be removably receivable by the receiving strap to substantially secure the secondary object to the mounting aspect. The storage aspect may receive and removably store a personal item. The storage aspect may include a back-storage surface provided by the mounting aspect, a storage panel, an interior storage space located between the back-storage surface and the storage panel, a storage flap manipulable to provide access to the interior storage space or substantially conceal the interior storage space, and electromagnetic shielding to substantially reduce radio frequency communication by the personal item stored by the storage aspect. The mounting aspect may be removable from and attachable to the primary object independently from attachment to the secondary object.

In another aspect, the mounting aspect may additionally include a second peripheral mounting panel attached to the primary mounting panel via a second mounting margin. The second peripheral mounting panel may be pivotable about the primary mounting panel via the second mounting margin.

In another aspect, the primary object may be a primary container with a primary container handle. The mounting aspect may be installable to the primary container handle. The secondary object may be a secondary container that is smaller than the primary container.

According to an embodiment of this disclosure, a method is provided for facilitating management of a primary object and a secondary object via a travel accessory comprising a mounting aspect and an attachment aspect. The method may include (a) securing the secondary object to the mounting aspect via the attachment aspect, further including the steps: (i) positioning a primary strap attached to a first mounting strap edge of a primary mounting panel of the mounting aspect around the secondary object, (ii) removably receiving the primary strap by a receiving strap attached to a second mounting strap edge of the primary mounting panel, and (iii) substantially securing the secondary object to the mounting aspect via the connected primary strap and receiving strap. The method may additionally include (b) securing the mounting aspect to the primary object, further including the steps: (i) locating the primary mounting panel of the mounting aspect adjacent to at least part of the primary object, and (ii) pivoting a first peripheral mounting panel attached to the primary mounting panel via a first mounting margin about the at least part of the primary object.

In another aspect, the method may include after step (b)(ii), (b)(iii) pivoting a second peripheral mounting panel attached to the primary mounting panel via a second mounting margin about the at least part of the primary object.

In another aspect, the method may include (c) reversibly storing a personal item via a storage aspect of the travel accessory. The storage aspect may include a back-storage surface provided by the mounting aspect, a storage panel, an interior storage space located between the back-storage surface and the storage panel, and optionally a storage flap manipulable to provide access to the interior storage space or substantially conceal the interior storage space. The method may additionally include (d) substantially reducing radio frequency communication by the personal item stored by the storage aspect via electromagnetic shielding.

In another aspect, the primary object may be a primary container comprising a primary container handle. Step (b)(ii) of the method may additionally include installing the mounting aspect to the primary container handle of the primary container.

Terms and expressions used throughout this disclosure are to be interpreted broadly. Terms are intended to be understood respective to the definitions provided by this specification. Technical dictionaries and common meanings understood within the applicable art are intended to supplement these definitions. In instances where no suitable definition can be determined from the specification or technical dictionaries, such terms should be understood according to their plain and common meaning. However, any definitions provided by the specification will govern above all other sources.

Various objects, features, aspects, and advantages described by this disclosure will become more apparent from the following detailed description, along with the accompanying drawings in which like numerals represent like components.

DETAILED DESCRIPTION

Figure 1:
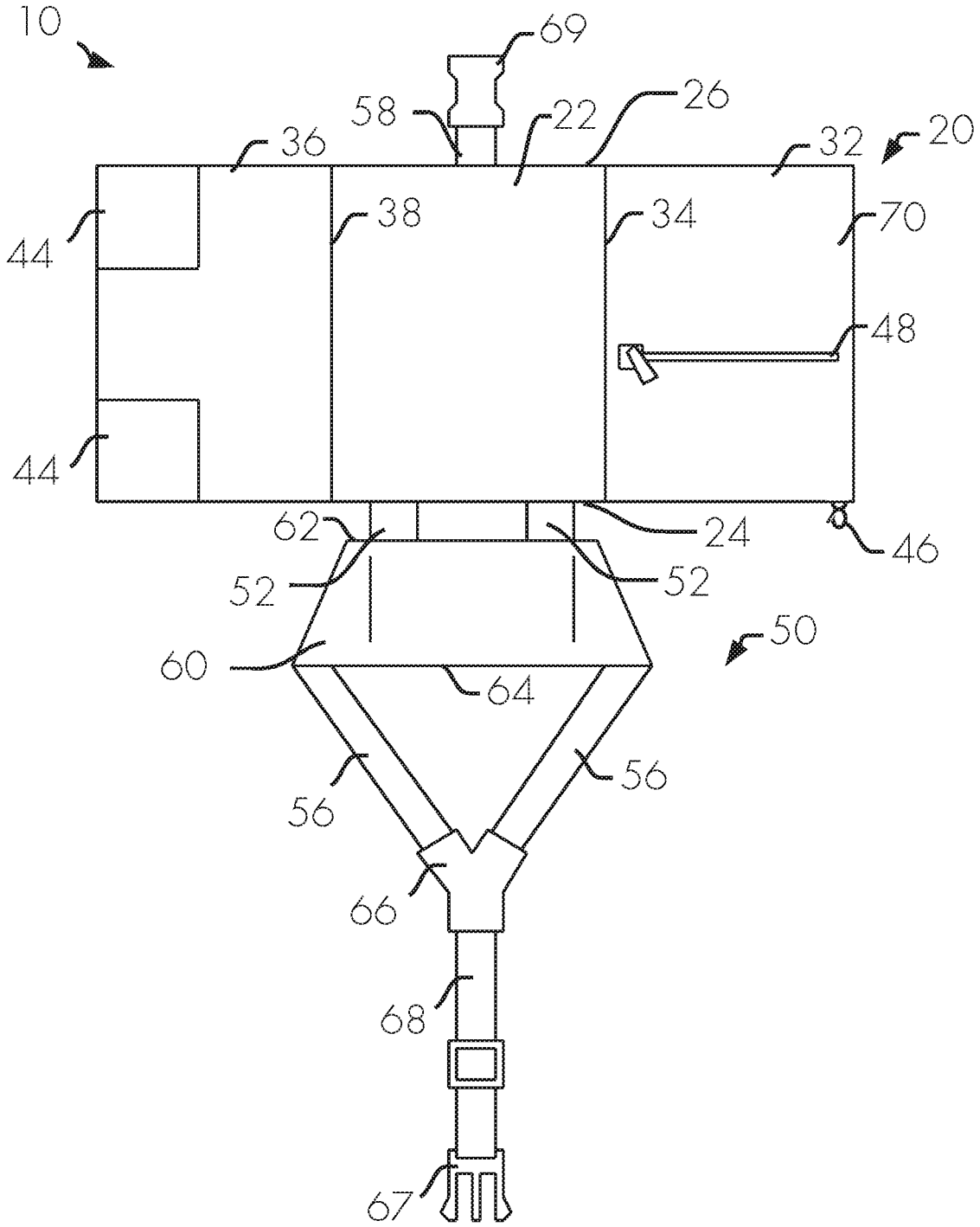
FIG. 1 is a top plan view of a travel accessory in an uninstalled configuration, according to an embodiment of this disclosure.
Figure 2:
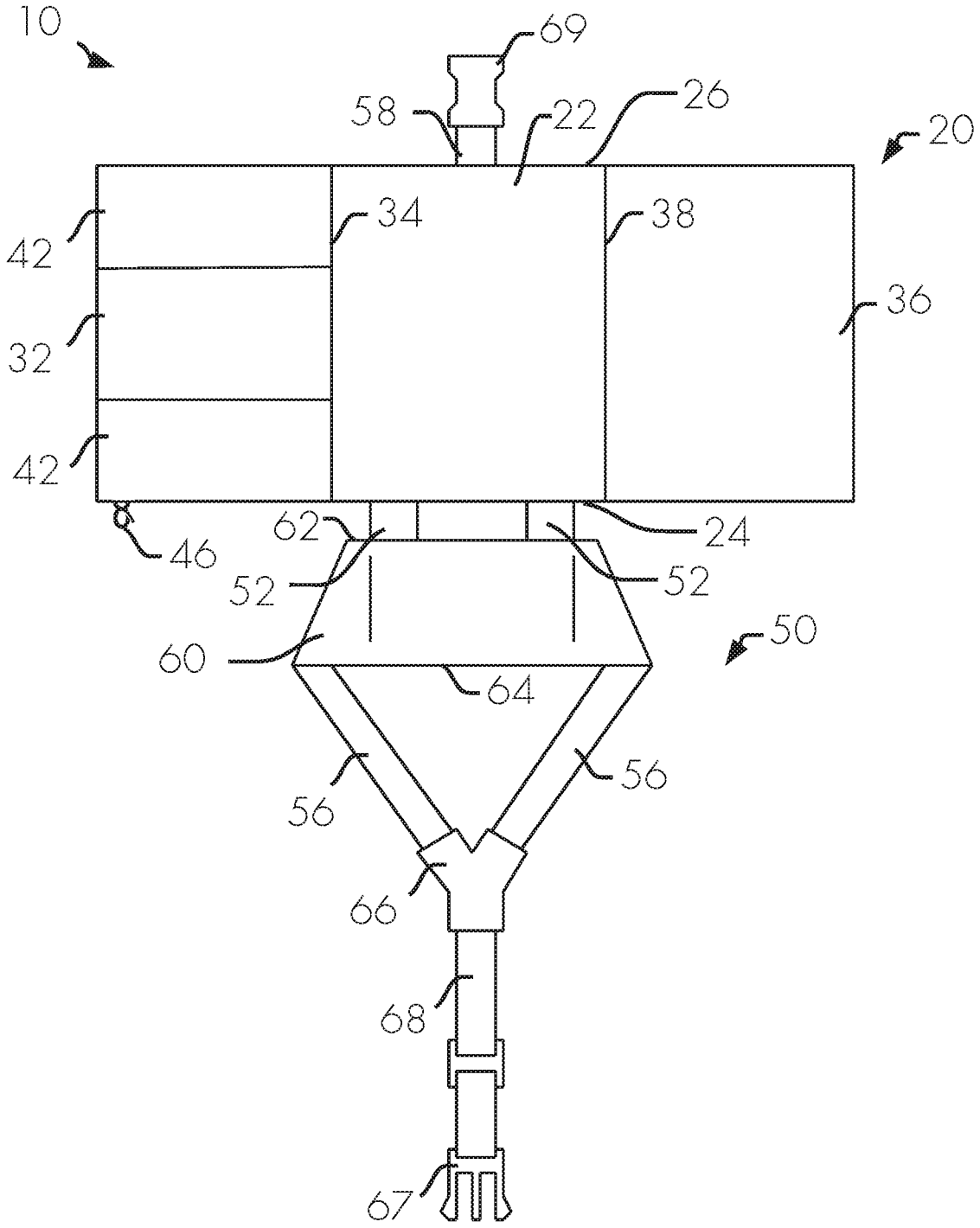
FIG. 2 is a bottom plan view of a travel accessory in an uninstalled configuration, according to an embodiment of this disclosure.
Figure 3:
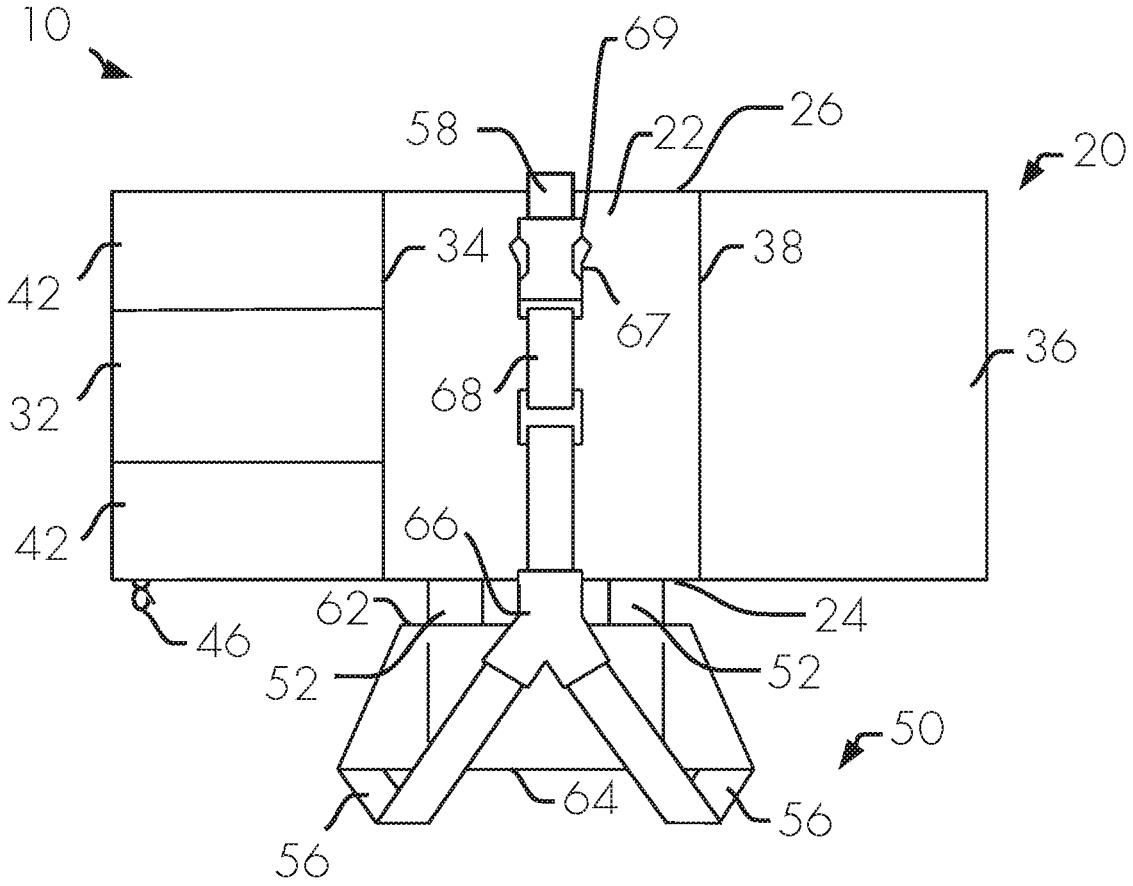
FIG. 3 is a top plan view of a travel accessory transitioning to a folded configuration, according to an embodiment of this disclosure.
Figure 4:
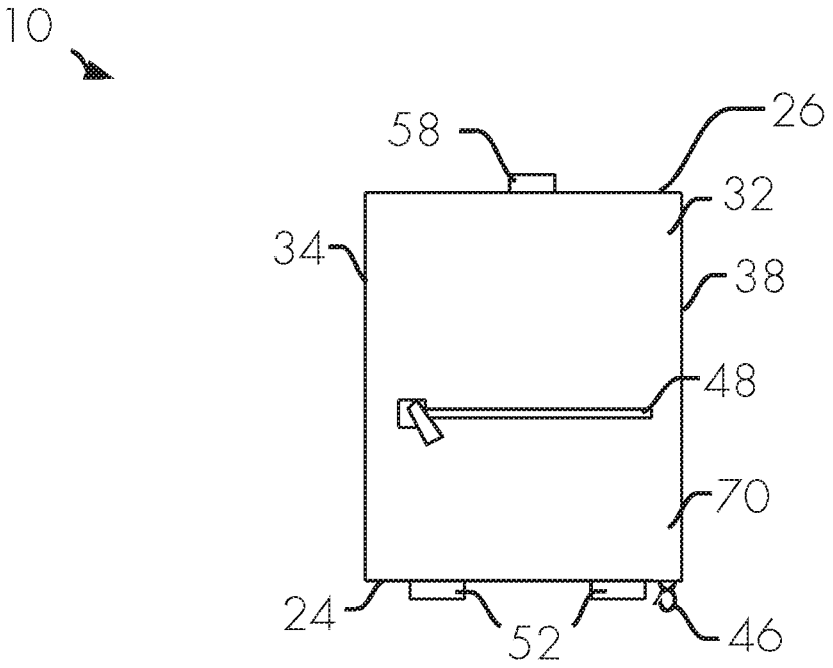
FIG. 4 is a top plan view of a travel accessory in a folded configuration, according to an embodiment of this disclosure.
Figure 5:
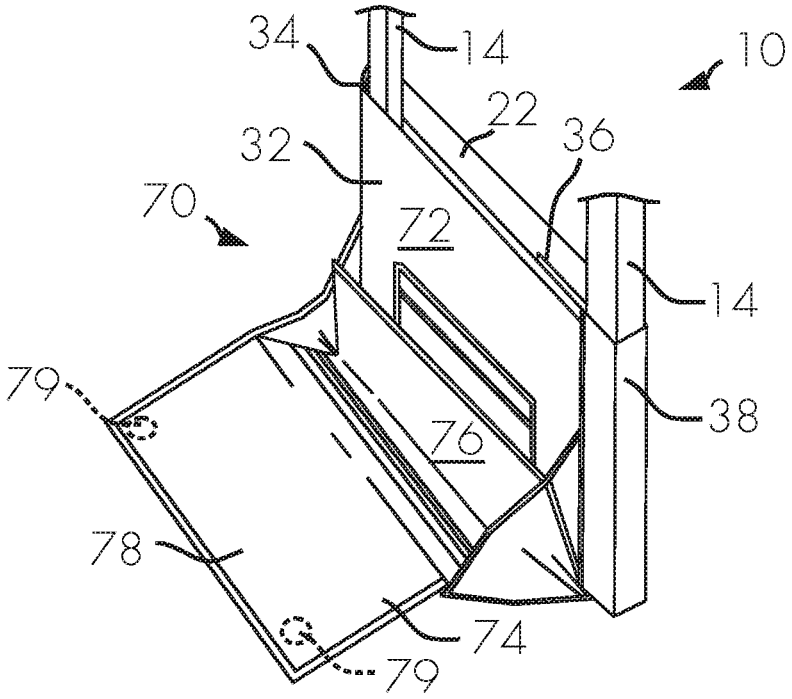
FIG. 5 is a perspective view of a storage aspect of a travel accessory, according to an embodiment of this disclosure.
Figure 6:
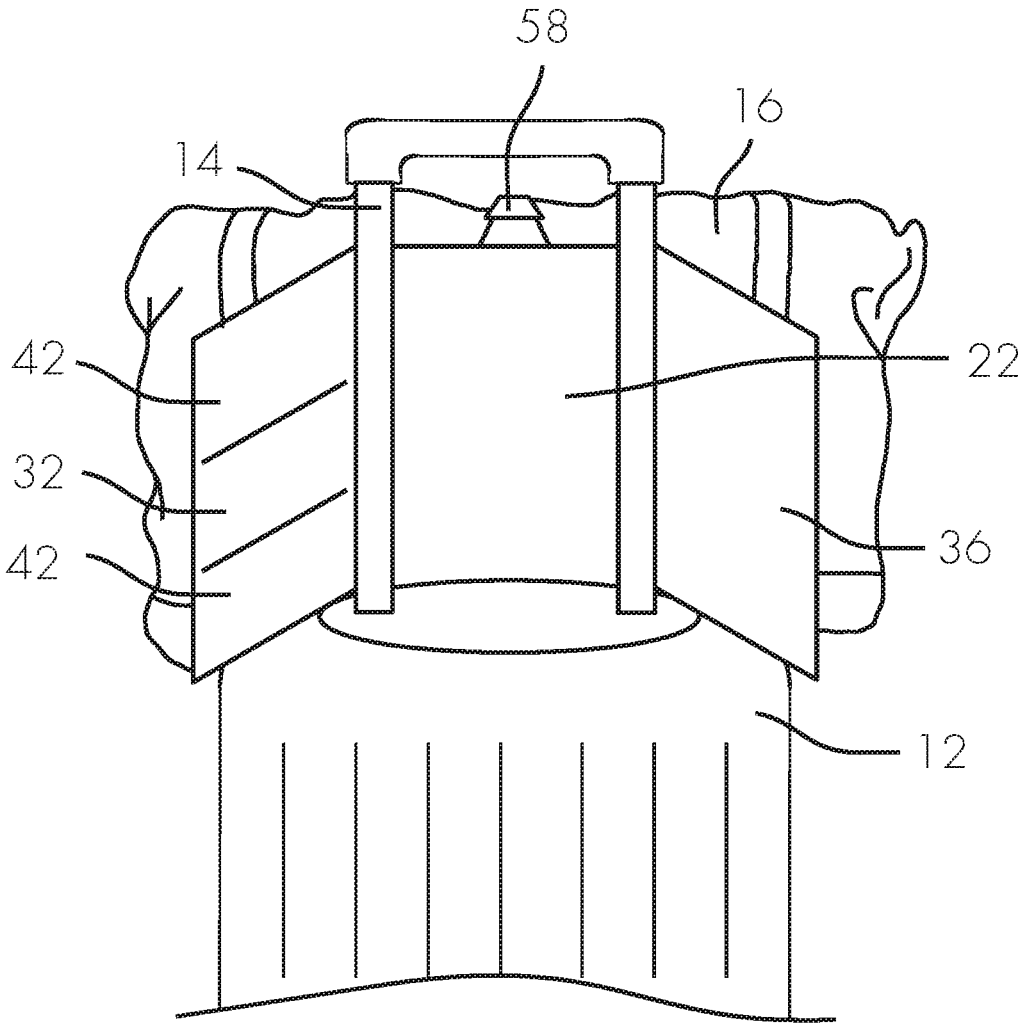
FIG. 6 is a perspective front view of a travel accessory partially installed to a primary object, according to an embodiment of this disclosure.
Figure 7:
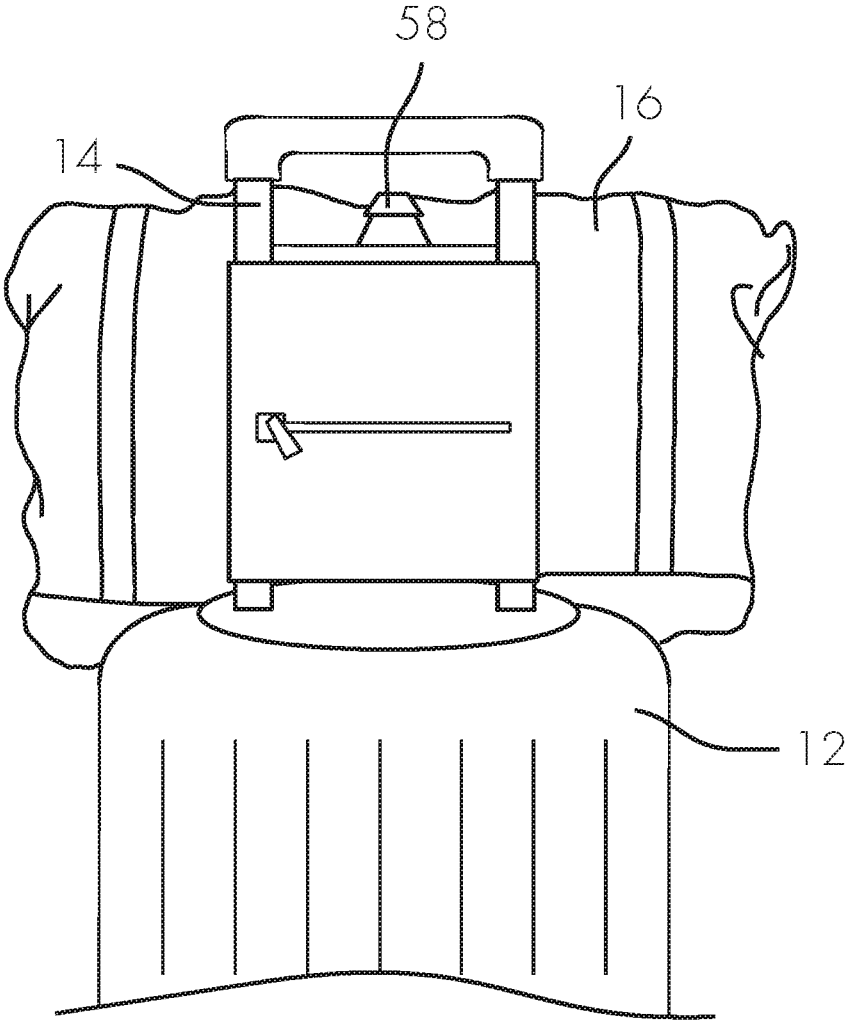
FIG. 7 is a perspective front view of a travel accessory installed to a primary object, according to an embodiment of this disclosure.
Figure 8:
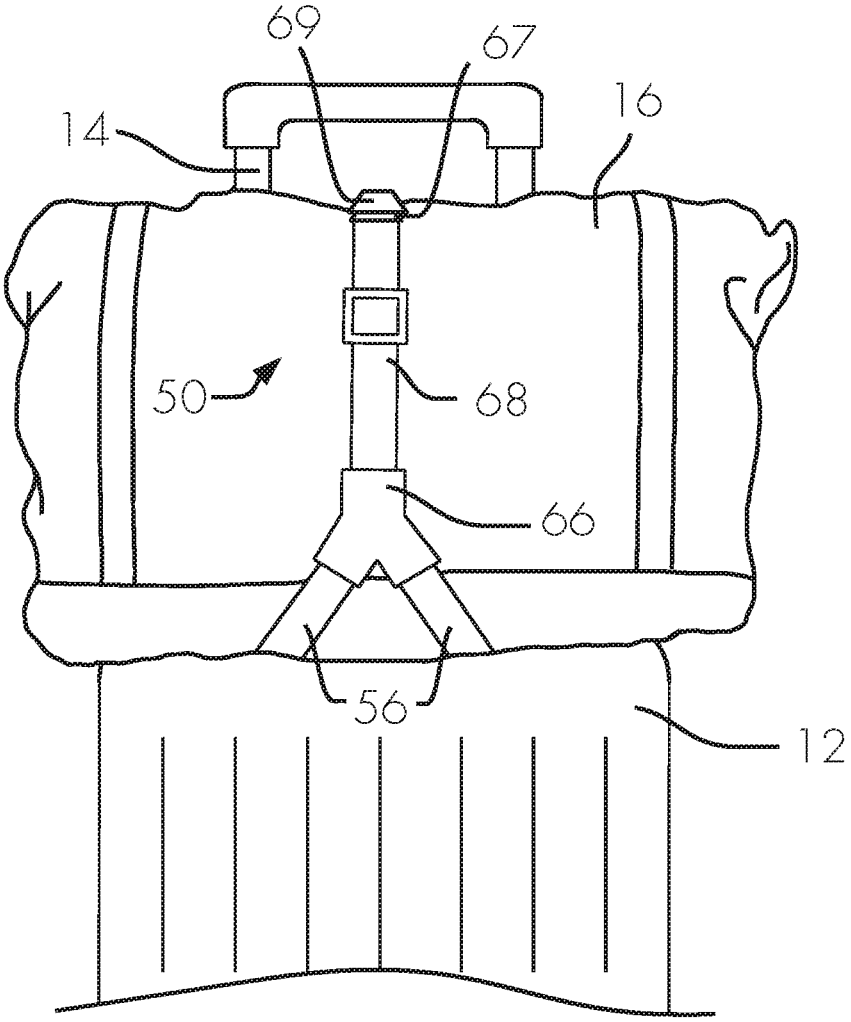
FIG. 8 is a perspective rear view of a travel accessory installed to a primary object, according to an embodiment of this disclosure.

The following disclosure is provided to describe various embodiments of a travel accessory. Skilled artisans will appreciate additional embodiments and uses of the present invention that extend beyond the examples of this disclosure. Terms included by any claim are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

Various aspects of the present disclosure will now be described in detail, without limitation. In the following disclosure, a travel accessory will be discussed. Those of skill in the art will appreciate alternative labeling of the travel accessory as a travel bag accessory, travel accessory, luggage holder, travel luggage and personal item holder, object securing device, the invention, or other similar names. Similarly, those of skill in the art will appreciate alternative labeling of the travel accessory as a device holding multiple objects, method of securing multiple luggage objects, securely and removably holding luggage in close proximity to one another operation, removably holding documents in close proximity to luggage technique, electromagnetically shielded personal item holding and luggage securing operation, method, operation, the invention, or other similar names. Skilled readers should not view the inclusion of any alternative labels as limiting in any way.

Referring now to FIGS. 1-10, the travel accessory will now be discussed in more detail. The travel accessory 10 may include a mounting aspect 20 with mounting panels, an attachment aspect 50 with straps, a storage aspect 70, and additional components and aspects that will be discussed in greater detail below. The travel accessory 10 may operate one or more of these components interactively with other components to assist with carrying and protecting objects such as containers or luggage, documents, and personal items. For the purpose of this disclosure, objects are intended to be interpreted broadly to include containers, luggage, and other things to which the travel accessory may be attached. Containers are intended to broadly include virtually any vessel into which something else may be located. For example, a primary object may broadly include a primary container and a secondary object may broadly include a secondary container, without limitation. At least some aspects of the travel accessory 10 may be constructed using fabrics or other flexible materials. Metallic fibers may be included to provide at least partial shielding of radio frequency communications.

A travel accessory 10 enabled by this disclosure may provide a number of advantages over current solutions. Some examples of advantages are provided below, without limitation. The travel accessory 10 may keep personal items substantially hidden and secure. The travel accessory 10 may include a document holder with organized pockets for documents, ID cards, credit cards, passports, and other personal items. The travel accessory 10 may include electromagnetic shielding to reduce the likelihood of unwanted communication of digital information via radio frequencies such as Wi-Fi, cellular networks, RFID, NFC, Bluetooth, and other electronic communications. A zippered pocket may be included to store various loose items substantially securely. Additionally, in some embodiments, a phone pocket may be provided to quickly store and access a phone or portable charger.

The mounting aspect will now be discussed in greater detail. FIGS. 1-7 highlight examples of the mounting aspect, which may also be shown in other figures. The mounting aspect 20 may allow the accessory to be removably mounted to the primary object 12, such as a rolling suitcase or other piece of luggage, without limitation. For example, the mounting aspect 20 may securely wrap around a primary object handle 14, such as an extendable handle of a rolling suitcase.

The mounting aspect 20 may include sections of material that are foldable on top of one another to wrap around a primary object handle 14. These sections of material are also referred to as mounting panels 22, 32, 36 throughout this disclosure, without limitation. The mounting aspect 20 may include one or more mounting panels 22, 32, 36, which may help with mounting the travel accessory 10 to the primary object 12, such as a piece of luggage. Mounting panels may include a primary mounting panel 22, a first peripheral mounting panel 32, a second peripheral mounting panel 36, and/or additional mounting panels. Skilled artisans will appreciate additional embodiments with more or less mounting panels to be included by this disclosure and should not limit the embodiments enabled by this disclosure to only the specific examples given.

In one example, each mounting panel 22, 32, 36 may have a first vertical end, a second vertical end, a first horizontal end, and a second horizontal end. Additionally, each mounting panel 22, 32, 36 may have an inner surface and an outer surface. Multiple mounting panels may be operatively connected to other mounting panels to provide the mounting aspect 20. For example, multiple mounting panels may be located adjacent to one another with one or more connective margins 34, 38, allowing a mounting panel to move about a neighboring mounting panel. The connection of mounting panels and margins between mounting panels may contribute to creating the mounting aspect 20.

In one example, the mounting aspect 20 may include a primary mounting panel 22 operatively attached to a first peripheral mounting panel 32 via a first mounting margin 34. The primary mounting panel 22 and the first peripheral mounting panel 32 may move about each other via the first mounting margin 34. An illustrative first mounting margin 34 may be a section of flexible material about which connected mounting panels 22, 32 may pivot.

In another example, the mounting aspect 20 may additionally include a secondary peripheral mounting panel 36 operatively attached to the primary mounting panel 22. The second peripheral mounting panel 36 may be attached to the primary mounting panel 22 via a second mounting margin 38. The primary mounting panel 22 and the second peripheral mounting panel 36 may move about each other via the second mounting margin 38. An illustrative second mounting margin 38 may be a section of flexible material about which connected mounting panels 22, 36 may pivot. In one example, the first mounting margin 34 and second mounting margin 38 may be located on opposite sides of the primary mounting panel 22.

The mounting panels 22, 32, 36 and other features of the mounting aspect 20 may be constructed using fabrics, flexible materials, rigid materials, and/or a combination of materials. One or more mounting panels 22, 32, 36 may be stitched to include a sleeve, into which a rigid material such as hard plastic may be inserted. Alternatively, fabric may be stitched around a rigid material to form a mounting panel 22, 32, 36. Inclusion of the rigid material may provide tension to assist with straps of the attachment aspect 50 being properly held in place around a secured secondary object 16, such as a bag or other luggage. In one embodiment, the panels may include hook-and-loop fasteners to enhance adjustability to fit a variety of suitcases or other objects. Examples of alternative fastening devices used with the securing interfaces 42, 44 may include hook-and-loop fasteners, magnetic fasteners, snaps, zippers, clasps, buttons, or other types of fasteners. The shape of the installed configuration may be flexible to advantageously accommodate differently configured pieces of luggage and their handles.

In one example, the mounting panels 22, 32, 36 may be constructed by substantially enclosing a rigid length of material with a fabric. For example, ballistic nylon, nylon, and/or other natural or synthetic fabrics may be used. Skilled artisans will appreciate embodiments omitting the rigid material to be additionally included by this disclosure. Mounting panels 22, 32, 36 may be constructed in virtually any shape. In the interest of clearly providing an example of a travel accessory 10 enabled by this disclosure, rectangular mounting panels 22, 32, 36 of fabric including an internal rigid material will be discussed without limitation.

In some embodiments, fabrics included by a travel accessory 10 may be at least partially water resistant. Additionally, electromagnetically shielded materials may be included by or located near the fabrics, for example, including a metallic mesh or Faraday shielding, as will be appreciated by those of skill in the art. The inclusion of electromagnetic shielding may assist with reducing undesired communication of radio frequency signals from items stored by the travel accessory 10.

In one embodiment, the mounting aspect 20 may be constructed using multiple lengths of fabric stitched together to form sleeves. Alternatively, a single length of fabric may be folded and stitched to create the mounting aspect. A rigid material, for example, hard plastic, may be inserted into the sleeves created between the fabric. The opening of the sleeve into which the rigid material was inserted may then be stitched substantially closed to create the mounting panels. The fabric between the substantially closed mounting panels may provide the margin. The fabric used in creating the mounting aspect may be at least partially elastic and/or stretchable, which may advantageously help the mounting panels adapt and accommodate pieces of luggage having different sizes and/or handles. The fabric used with the mounting aspect may be configured with various stitching and/or color combinations.

The mounting panels 22, 32, 36 may include various features to provide functionality to the mounting aspect 20. For example, one or more mounting panels 22, 32, 36 may include features to assist with securing the mounting aspect 20 to a primary object 12, secondary object 16, or another object. Illustrative securing interfaces 42, 44 may include hook-and-loop fasteners, magnetic fasteners, buttons, snaps, adhesive, zippers, buckles, clasps, straps, strings, and other interfaces that would be apparent to skilled artisans after having the benefit of this disclosure. Additionally, one or more mounting panels 22, 32, 36 may include connection points for the straps included by the attachment aspect 50, which will be discussed in greater detail below. Mounting panels 22, 32, 36 may include other features, such as pockets provided by the storage aspect 70, which will also be discussed in greater detail below.

In one example, a first portion 42 of the securing interface may be located on a surface of the first peripheral mounting panel 32. Additionally, a second portion 44 of the securing interface may be located on a surface of the second peripheral mounting panel 36. The first and second portions 42, 44 of the securing interfaces may be configured such that when the first and second peripheral mounting panels 32, 36 are rotated about their respective margins 34, 38 shared with the primary mounting panel 22, the first and second peripheral mounting panels 32, 36 may be removably connected via the securing interfaces 42, 44.

As an example, the first portion 42 of the securing interfaces may be received by the second portion 44 of the securing interfaces. In an example using hook-and-loop fasteners, the first portion 42 may include the hook portion and the second portion 44 may include the loop portion. When the peripheral mounting panels 32, 36 are rotated about the margins 34, 38 shared with the primary mounting panel 22, the loops may be received by the hooks, removably securing the mounting panels 22, 32, 36 of the mounting aspect 20 together. Skilled artisans will appreciate additional examples using magnets, snaps, and other interfaces, without limitation.

Those of skill in the art will appreciate this disclosure to additionally include embodiments with more or less than three mounting panels. For example, an embodiment with two mounting panels may fold about a single margin which may be located between the first vertical end of a first mounting panel and a second vertical end of a second mounting panel. In another example, an embodiment with four mounting panels may have additional connection interfaces to provide expanded folding options, including vertically folding a mounting panel about a margin between a first horizontal end of one mounting panel and a second horizontal end of a neighboring mounting panel.

One or more of the panels may include additional features, such as a clasp 46, zipper pocket 48, or other feature to assist with carrying, holding, or otherwise securing personal items. For example, the clasp 46 may be used to assist with holding keys, a camera strap, phone case, lanyard, or other item. The zipper pocket 48 may be used to store an ID, cash, credit card, passport, phone, or other item. In alternative embodiments, the pocket 48 may be sealable by another technique other than a zipper.

The panels may be folded upon each other to be substantially flat. Parts of the attachment interface 50 may be positioned to be concealed when the panels of the mounting interface 20 are folded upon each other. This configuration advantageously facilitates stows or storing the travel accessory 10 in luggage, a purse, a briefcase, or another location to take up little room when not needed.

The attachment aspect will now be discussed in greater detail. FIGS. 1-3, 6-8 highlight examples of the attachment aspect, which may also be shown in other figures. The attachment aspect 50 may allow the travel accessory 10 to attach to a secondary object 16, such as a duffel bag or luggage. The attachment aspect 50 may include straps 52, 58 extending outwardly from the mounting aspect 20. In one embodiment, the straps may include at least one upper primary strap 52 and a receiving strap 58. One or more of the straps 52, 58 included by the attachment aspect 50 may be installed to the mounting aspect 20 via stitching, adhesive, welding, compression, or other attachment techniques that would be appreciated by a person of skill in the art after having the benefit of this disclosure.

The straps may be created using various fabrics and/or materials. For example, the straps may include nylon, canvas, or other materials. In another example, the straps may be at least partially elastic. For example, the straps may be at least partially stretchable to facilitate accommodating objects of varying sizes.

At least part of the upper primary straps 52 included by the attachment aspect 50 and extending outwardly from the mounting aspect 20 may be passed at least partially through an optional support panel 60 to help keep the upper primary straps 52 at a desired location respective to one another. The support panel 60 may include one or more positioning panels, which may be constructed in a manner similarly to the mounting panels 20 discussed above. For example, the positioning panels of the support panel 60 may be constructed using fabric and rigid materials.

The fabric used in creating the attachment aspect 50 may be at least partially elastic and/or stretchable, which may advantageously help the support panel 60 adapt and accommodate pieces of luggage of different sizes. The fabric could include various stitching and/or coloring options. The support panel 60 may be configured in varying sizes and shapes, for example, rectangular, triangular, or other shapes.

In a more specific example, provided without limitation, an illustrative support panel 60 may include three positioning panels: a central positioning panel, a first peripheral positioning panel, and a second peripheral positioning panel. The central positioning panel may be rectangular, including a first vertical end, second vertical end, first horizontal end, and second horizontal end. The peripheral positioning panels may be triangular, including a respective vertical end, diagonal end, and horizontal end. The end opposite to the horizontal end may approximately form a point where the vertical end and the diagonal end approximately converge. In one example, and without limitation, the peripheral panels may be right triangles.

The central positioning panel may connect to a peripheral positioning panel via a margin. For example, the first vertical end of the central positioning panel may connect to the vertical end of the first peripheral positioning panel via a first positioning central-peripheral margin. Similarly, the second vertical end of the central positioning panel may connect to the vertical end of the second peripheral positioning panel via a second positioning central-peripheral margin. The positioning panels may be arranged such that the second horizontal end of the central positioning panel and the horizontal ends of the peripheral positioning panels are approximately level. The positioning panels may substantially pivot about the margins between each positioning panel.

One or more upper primary straps 52 may be passed through and/or attached to one or more of the positioning panels of the support panel 60. For example, a first upper primary strap 52 may extend outwardly from the primary mounting panel 22 for a configurable length, after which it may be received by the first support panel edge 62 of the support panel 60. Similarly, a second upper primary strap 52 may extend outwardly from the primary mounting panel 22 for a configurable length, after which it may be received by the first support panel edge 62 of the support panel 60.

The upper primary straps 52 may be directed through the support panel 60 until exiting at the second support panel edge 64. Alternatively, the upper primary straps 52 may be installed to the first support panel edge 62 of the support panel 60 and separate lower primary straps 56 may be installed to the second support panel edge 64 of the support panel 60. The lower panel straps 56 may extend outwardly from the second support panel edge 64.

The straps, whether upper primary straps 52 passing through a support panel 60, lower primary straps 56 attached to the support panel 60, or other types of straps, may continue to extend beyond the support panel 60 to a distal end. In embodiments omitting the support panel 60, the straps may extend outwardly from the mounting aspect 20 to a distal end.

In one embodiment, multiple upper primary straps 52 may converge into one or more link straps 68, optionally including lower primary straps 56. In the interest of clarity, an example including two upper primary straps 52 passing through a support panel 60 and converging into one link strap 68 is discussed. However, those of skill in the art will appreciate that alternative configurations with varying numbers of upper primary straps 52, lower primary straps 56, strap junctions 66, and other features are intended to be included by this disclosure.

In this example, the attachment aspect 50 may include a first and second upper primary strap 52 extending outwardly from a first mounting strap edge 24 of the primary mounting panel 22 of the mounting aspect 20, near the margins 34, 38 between the primary mounting panel 22 and peripheral mounting panels 32, 36. The first and second upper straps 52 may be installed to the mounting aspect 20 via stitching, adhesive, welding, or other attachment techniques. In one embodiment, the first and second upper straps 52 may be attached to the mounting panel 22 such that the upper straps are removable and replaceable. The first and second upper straps 52 may extend outwardly from the mounting aspect 20 to be received by the support panel 60 along the diagonal ends of the first and second peripheral positioning panels, respectively. The first and second upper straps 52 may be installed to the support panel 60 via stitching, adhesive, welding, or other attachment techniques.

The first and second upper straps 52 may extend outwardly from the support panel 60 to a strap junction 66. The first and second upper straps 52 may join at the strap junction 66, with a link strap 68 extending outwardly approximately away in direction from the upper straps. In one embodiment, the first and second upper straps 52 may be attached to a link strap 68 at the strap junction 66. In another embodiment, the first and second upper straps 52 may be operatively attached to first and second lower straps 56 via the support panel 60, with the first and second lower straps 56 being attached to one another at the strap junction 66. In yet another embodiment, one or more upper straps 52 and/or one or more lower straps 56 may be connected at the strap junction 66, with one of the straps terminating at the strap junction 66 and the other strap continuing past the strap junction 66, now as a link strap 68. The link strap 68 may then continue to a primary connection interface 67.

The link strap 68 may optionally pass through a length adjustment member to provide variability in the strap length. For example, the link strap 68 may pass through a slider, which may provide an adjustable length. The link strap 68 may then be attached to the primary connection interface 67 via looping the strap through an opening, stitching, welding, adhesive, and/or other attachment technique.

The attachment aspect 50 may additionally include a receiving strap 58 extending outwardly from the mounting aspect 20. In one embodiment, without limitation, the receiving strap 58 may be attached to the second mounting strap edge 68 of the primary mounting panel 22 of the mounting aspect 20. In one embodiment, the receiving strap 58 may be attached to the second mounting strap edge 68 of the primary mounting panel 22 such that it is removable and replaceable.

In one example, the receiving strap 58 may extend outwardly in a direction opposite to the upper and/or lower primary straps 52, 56, such as from a second mounting strap edge 26 of the mounting aspect 20. The receiving strap 58 may optionally pass through a length adjustment member to provide variability in the receiving strap length. For example, the receiving strap 58 may pass through a slider, which may provide an adjustable length. The receiving strap 58 may then continue to a receiving connection interface 69. The receiving strap 58 may then be attached to the receiving connection interface 69 via looping the strap through an opening, stitching, welding, adhesive, and/or other attachment technique.

The attachment aspect 50 connection interface may include connection interfaces 67, 69 to removably connect the straps included by the attachment aspect 50. For example, primary connection interface 67 and receiving connection interface 69 may operatively and removably connect to substantially secure the upper and/or lower primary straps 52, 56 with the receiving strap 58. In one embodiment, the primary connection interface 67 and receiving connection interface 69 may be male and female portions of a clip. In other embodiments, the connection interfaces could include buttons, snaps, buckles, hook-and-loop fasteners, magnetic fasteners, and other attachment interfaces that would be apparent to a person of skill in the art after having the benefit of this disclosure. One or more of the straps may include elastic webbing. One or more of the straps may include materials to resist unintended deformation.

The storage aspect will now be discussed in greater detail. FIGS. 1, 4-5, and 7 highlight examples of the storage aspect, which may also be shown in other figures. The storage aspect 70 may include pockets attached to the mounting aspect 20, for example, on an outward facing surface of the mounting aspect 20. The pockets may be configured to receive and hold ID cards, passports, plane tickets, mobile phones, wallets, money, personal electronic devices, and other objects. The storage aspect 70 may optionally be included on multiple mounting panels of the mounting aspect, advantageously providing increased storage.

In another embodiment, the storage aspect 70 may include a back-storage surface 72 of the mounting aspect 20 and a storage panel 74. For example, one or more edge of the storage panel 74 may be mounted to a portion of the back-storage surface 72 of the mounting aspect 20. The storage panel 74 may pivot or otherwise move about the connection between the storage panel 74 and the back-storage surface 72 such to create an interior storage space 76. In one example, sections of fabric may be included between the bottom and sides of the storage panel 74 to connect to the back-storage surface 72 to create a pocket at least partially enclosing the interior storage space 76 of the storage aspect 70.

The storage aspect 70 may include one or more securing features, such as a storage flap 78 to substantially enclose and/or provide access to the interior storage space 76 of the storage aspect 70. The storage flap 78 may include storage flap magnets 79 to assist with keeping the storage flap 78 in a desired orientation respective to opened or closed configurations. Additionally, zippers, hook-and-loop fasteners, magnetic fasteners, snaps, or other features may be used to keep the storage flap 78 in a desired orientation.

Fabrics used in constructing the storage aspect 70 and/or associated pockets may include attributes such as being solid, mesh, transparent, translucent, woven, stitched, electromagnetically shielded, RFID-enabled, and/or other attributes that will be appreciated by a person of skill in the art after having the benefit of this disclosure. The pockets advantageously allow a user to store their items with their luggage while going through security, such as TSA security at an airport.

In one embodiment, one or more pockets may be included on an inner surface of the mounting aspect to securely hold documents, ID cards, money, and other items. The pockets and other parts of the storage aspect 70 may include wire meshes, Faraday shielding materials, or other features to help reduce or block transmission of sensitive data, RFID tags, wireless data transmissions, or other communications. Blocked and/or attenuated communications may include, without limitation, ranges of radio frequency used by Wi-Fi, cellular signals, near field communication (NFC), smart chips, RFID, and others.

In some embodiments, the storage aspect 70 may include options for charging personal electronics, such as by including space to receive a battery and electrical connection interface. In at least one embodiment, the storage aspect 70 may include the battery and charging interface.

The storage aspect 70 may be attached to the mounting aspect 20 via stitching, adhesive, welding, zipper, button, or other attachment techniques that would be appreciated by a person of skill in the art. The storage aspect 70 may be configured such that upon uninstalling the mounting aspect 20 from the primary object 12, such as a piece of luggage, the storage aspect 70 remains accessible with the attachment aspect 50 installed to the secondary object 16, such as a second piece of luggage. This configuration may be advantageous when separating a secondary object 16 from a primary object 12, such as a duffel bag from a rolling suitcase, when passing through travel security.

When not in use, the mounting panel 74 of the mounting aspect 70 may be folded inward to reduce the size of the travel accessory 10 for storage. The straps and other features of the attachment aspect 50 may be stored in the space enclosed within the mounting aspect 20 when the mounting panels 22, 32, 36 are folded about each other. The storage aspect 70 may face outwardly giving the user continued access to their documents and other personal items.

In operation, a method may be provided for carrying and protecting multiple objects, including pieces of luggage, documents, and personal items. Those of skill in the art will appreciate that the following methods are provided to illustrate an embodiment of the disclosure and should not be viewed as limiting the disclosure to only those methods or aspects. Skilled artisans will appreciate additional methods within the scope and spirit of the disclosure for performing the operations provided by the examples below after having the benefit of this disclosure. Such additional methods are intended to be included by this disclosure.

In an illustrative use example, the mounting panels of the mounting interface may be wrapped around the primary object, for example, around the handle of a rolling suitcase. The orientation of the storage aspect when the travel accessory is installed on the primary piece of luggage may provide pockets and/or an interior storage space of the storage aspect as oriented outwardly and accessible to a user. The straps of the attachment aspect extending outwardly from the mounting aspect may be wrapped around the secondary object, for example, a duffel bag. The straps may be secured to the connection interface, for example, via clips or buckles at the end of the straps. When the straps are connected, the travel accessory may substantially secure the duffel bag to the rolling suitcase. A traveler may place their items in the pockets and/or interior storage space of the storage aspect for safe keeping.

In one example, when passing through airport security, a traveler may quickly remove the mounting aspect from the rolling suitcase while leaving the attachment aspect securely wrapped around the duffel bag. The traveler's ID, tickets, phone, and other items may remain with the duffel bag in the pockets of the storage aspect. Once the traveler has finished passing through security, the traveler may simply wrap the mounting panels of the mounting aspect around the handle of the rolling suitcase again, securing the duffel bag to the rolling suitcase, and be on their way.

Figure 9:
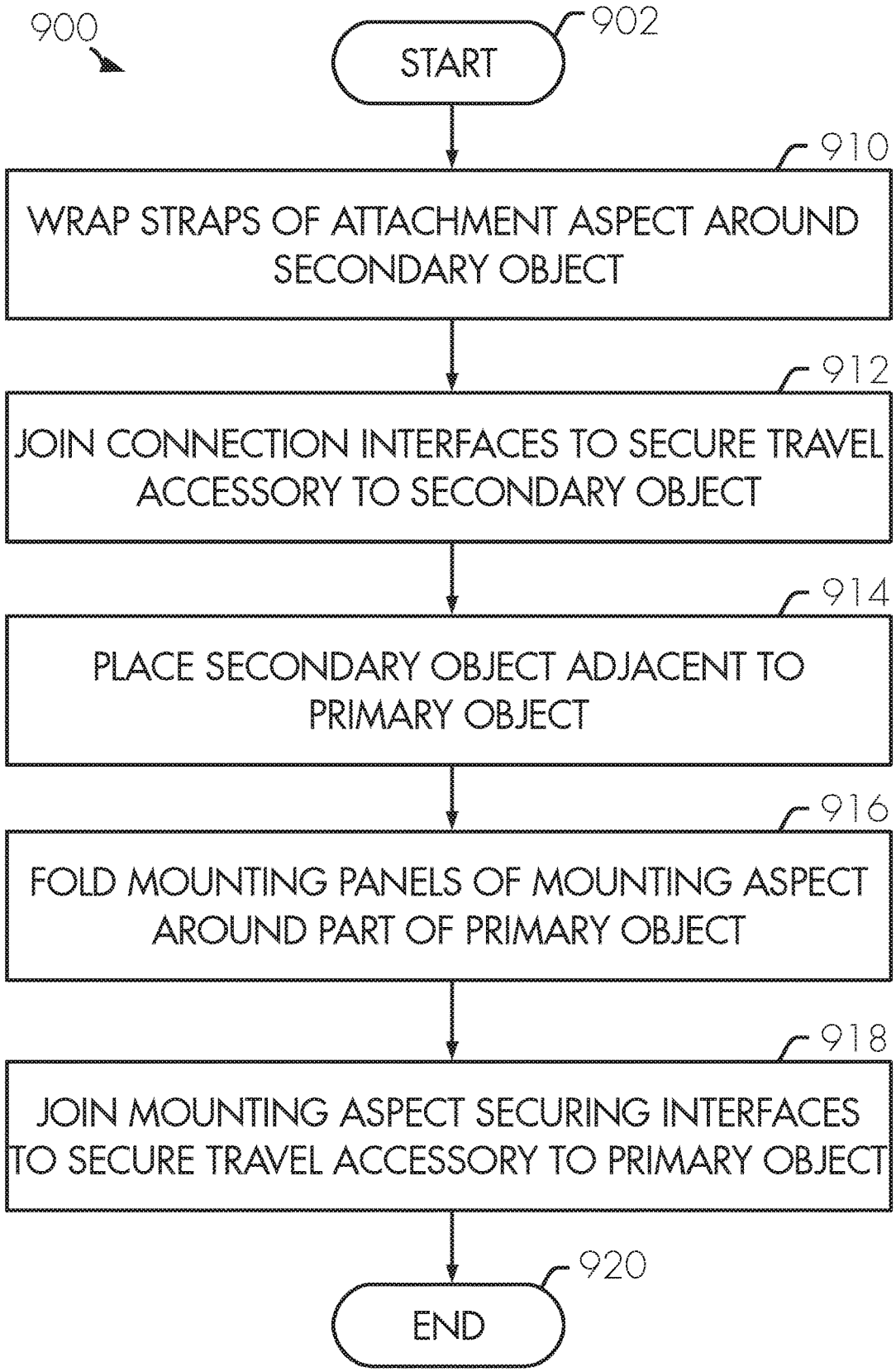
FIG. 9 is a flow chart view of an installation of the travel accessory to a primary object, according to an embodiment of this disclosure.

Referring now to flowchart 900 of FIG. 9, an illustrative method for an installation of the travel accessory to a primary object will be described, without limitation. Starting with block 902, the operation may begin by a user wrapping straps of the attachment aspect around the secondary object, for example, a duffel bag (block 910). The connection interfaces at the ends of the straps may then be joined to secure the travel accessory to the secondary object (block 912). The secondary object may then be located adjacent to the primary object, for example, stacked on top of a rolling suitcase (block 914). The mounting panels of the mounting aspect may be folded around part of the primary object, for example, the handle of a rolling suitcase (block 916). The securing interfaces, for example hook-and-loop fasteners, of the mounting aspect may be joined to secure the travel accessory to the primary object (block 918). The operation may then terminate at block 920.

Figure 10:
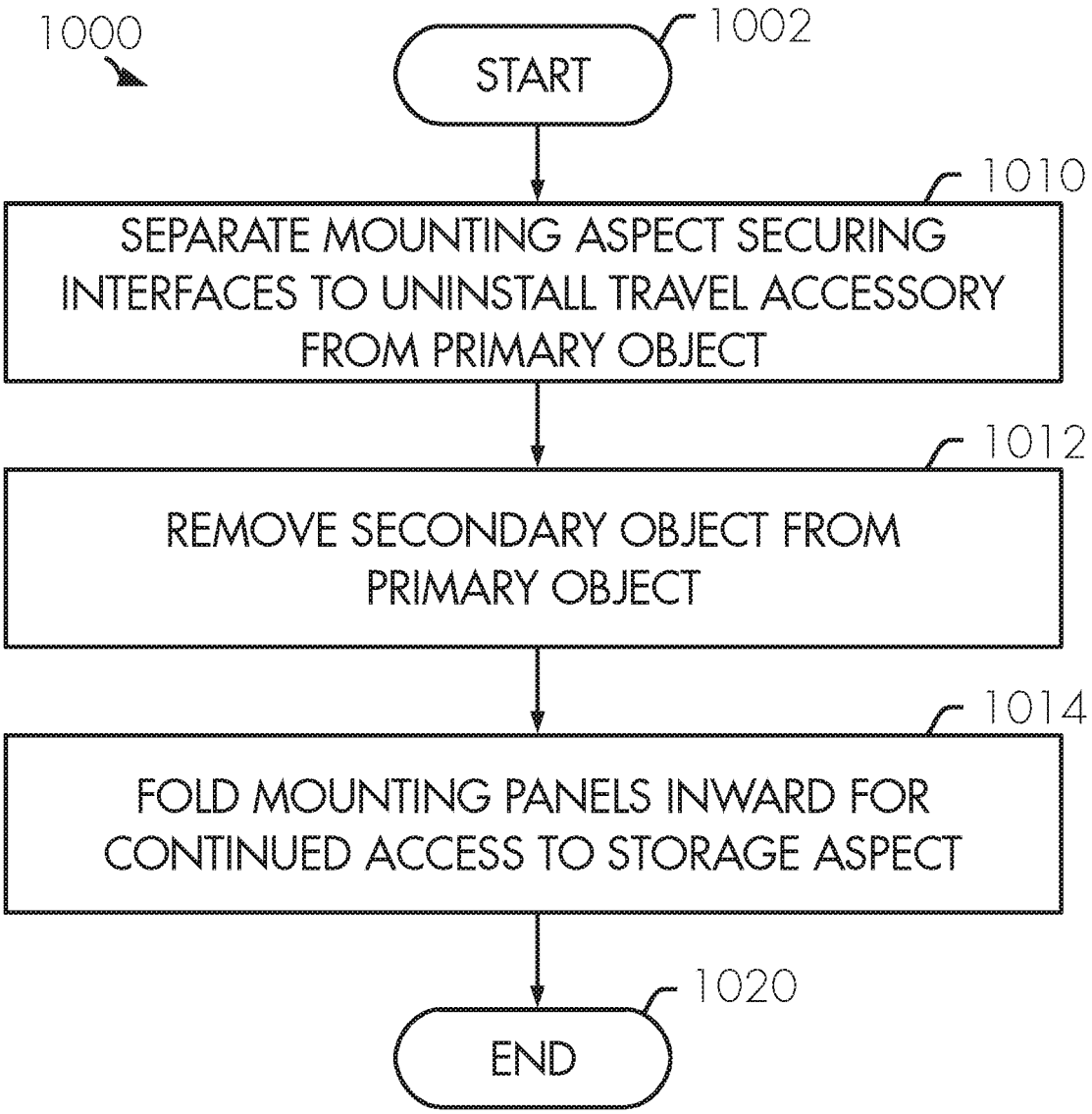
FIG. 10 is a flow chart view of a removal of the travel accessory from a primary object, according to an embodiment of this disclosure.

Referring now to flowchart 1000 of FIG. 10, an illustrative method for a removal of the travel accessory from a primary object will be described, without limitation. Starting with block 1002, the operation may begin by separating the mounting aspect securing interfaces to uninstall the travel accessory from the primary object, such as a rolling suitcase (block 1010). The secondary object, such as a duffel bag, may then be removed from the primary object, such as the rolling suitcase (block 1012). The mounting panels may be folded inward for continued access to the storage aspect and included items (block 1014). The travel accessory may conveniently remain installed to the secondary object, for example duffel bag, allowing easy reinstallation to the primary object, for example rolling suitcase, when the objects no longer should be separated. The operation may then terminate at block 1020.

An alternative illustrative method for removal of the travel accessory will now be described, without limitation. This illustrative operation may begin by separating the attachment aspect securing interface to uninstall the travel accessory from the secondary object, for example duffel bag. The secondary piece of luggage may then be removed from the primary object, for example rolling suitcase, such as by unclipping straps around the secondary object. The straps of the attachment device may be tucked or otherwise stored with the primary object, for example rolling suitcase. The storage aspect may remain with the primary object in this illustrative operation. The travel accessory may conveniently remain installed to the primary object, for example rolling suitcase, allowing easy reinstallation of the secondary object, for example duffel bag, to the primary object when the objects no longer should be separated.

While various aspects have been described in the above disclosure, the description of this disclosure is intended to illustrate and not limit the scope of the invention. The invention is defined by the scope of the appended claims and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the following claims.

What is claimed is:

1. A travel accessory comprising:

a mounting aspect for attaching to a primary object comprising:

a primary mounting panel, a first peripheral mounting panel attached to the primary mounting panel via a first mounting margin, and wherein the first peripheral mounting panel is pivotable about the primary mounting panel via the first mounting margin to fold over at least part of the primary object to attach to and be selectively removed from the primary object;

an attachment aspect for securing a secondary object to the mounting aspect and being selectively removable from the secondary object comprising:

a primary strap attached to a first mounting strap edge of the primary mounting panel, a receiving strap attached to a second mounting strap edge of the primary mounting panel, and wherein the primary strap is removably receivable by the receiving strap to substantially secure the secondary object to the mounting aspect;

a storage aspect to receive and removably store a personal item comprising:

a back-storage surface provided by the mounting aspect, a storage panel, and an interior storage space located between the back-storage surface and the storage panel; and wherein the mounting aspect is selectively removable from and attachable to the primary object independently from attachment to the secondary object.

2. The travel accessory of claim 1, wherein the mounting aspect further comprises:

a second peripheral mounting panel attached to the primary mounting panel via a second mounting margin; and wherein the second peripheral mounting panel is pivotable about the primary mounting panel via the second mounting margin to fold over at least part of the primary object to attach to and be selectively removed from the primary object.

3. The travel accessory of claim 2:

wherein the primary mounting panel comprises a primary mounting panel insert being at least partially rigid;

wherein the first peripheral mounting panel comprises a first peripheral mounting panel insert being at partially rigid; and wherein the second peripheral mounting panel comprises a second peripheral mounting panel insert being at least partially rigid.

4. The travel accessory of claim 3:

wherein the first margin and is distinct from the primary mounting panel and the first peripheral mounting panel;

wherein the second margin is distinct from the primary mounting panel and the second peripheral mounting panel;

wherein the first margin is located between the primary mounting panel and the first peripheral mounting panel;

wherein the first margin is substantially non-rigid;

wherein the second margin is located between the primary mounting panel and the second peripheral mounting panel; and wherein the second margin is substantially non-rigid.

5. The travel accessory of claim 1, wherein the primary object is a primary container comprising a primary container handle;

wherein the mounting aspect is installable to the primary container handle; and wherein the secondary object is a secondary container that is smaller than the primary container.

6. The travel accessory of claim 1:

wherein the primary mounting panel comprises a primary mounting panel insert being at least partially rigid; and wherein the first peripheral mounting panel comprises a first peripheral mounting panel insert being at partially rigid.

7. The travel accessory of claim 6:

wherein the first margin is distinct from the primary mounting panel and the first peripheral mounting panel;

wherein the first margin is located between the primary mounting panel and the first peripheral mounting panel; and wherein the first margin is substantially non-rigid.

8. A method for facilitating management of a primary object and a secondary object via a travel accessory comprising a mounting aspect and an attachment aspect, the method comprising:

(a) securing the secondary object to the mounting aspect via the attachment aspect, further comprising:

(i) positioning a primary strap attached to a first mounting strap edge of a primary mounting panel of the mounting aspect around the secondary object, (ii) removably receiving the primary strap by a receiving strap attached to a second mounting strap edge of the primary mounting panel, and (iii) substantially securing the secondary object to the mounting aspect via the connected primary strap and receiving strap; and (b) securing the mounting aspect to the primary object, further comprising:

(i) locating the primary mounting panel of the mounting aspect adjacent to at least part of the primary object, and (ii) pivoting a first peripheral mounting panel attached to the primary mounting panel via a first mounting margin to fold over the at least part of the primary object;

wherein the mounting aspect is selectively removable from the primary object; and wherein the attachment aspect is selectively removable from the secondary object.

9. The method of claim 8, further comprising after step (b)(ii):

(b)(iii) pivoting a second peripheral mounting panel attached to the primary mounting panel via a second mounting margin about the at least part of the primary object.

10. The method of claim 8, further comprising:

(c) selectively removably storing a personal item via a storage aspect of the travel accessory; and wherein the storage aspect comprises:

a back-storage surface provided by the mounting aspect, a storage panel, and an interior storage space located between the back-storage surface and the storage panel.

11. The method of claim 8, wherein the primary object is a primary container comprising a primary container handle, and wherein step (b)(ii) further comprises installing the mounting aspect to the primary container handle of the primary container.

12. The method of claim 8:

wherein the primary mounting panel comprises a primary mounting panel insert being at least partially rigid; and wherein the first peripheral mounting panel comprises a first peripheral mounting panel insert being at partially rigid.

13. The method of claim 12:

wherein the first margin is distinct from the primary mounting panel and the first peripheral mounting panel;

wherein the first margin is located between the primary mounting panel and the first peripheral mounting panel; and wherein the first margin is substantially non-rigid.

14. The method of claim 8:

wherein the primary mounting panel comprises a primary mounting panel insert being at least partially rigid;

wherein the first peripheral mounting panel comprises a first peripheral mounting panel insert being at partially rigid; and wherein the second peripheral mounting panel comprises a second peripheral mounting panel insert being at least partially rigid.

15. The method of claim 14:

wherein the first margin and is distinct from the primary mounting panel and the first peripheral mounting panel;

wherein the second margin is distinct from the primary mounting panel and the second peripheral mounting panel;

wherein the first margin is located between the primary mounting panel and the first peripheral mounting panel;

wherein the first margin is substantially non-rigid;

wherein the second margin is located between the primary mounting panel and the second peripheral mounting panel; and wherein the second margin is substantially non-rigid.

* * * * *